US005813371A

United States Patent [19]

Peel

[11] Patent Number: 5,813,371

[45] Date of Patent: Sep. 29, 1998

[54] COMPUTERIZED INTERNAL SUPERCHARGED ENGINE-PUMP

[76] Inventor: George Keith Peel, 1901 S. First St., Temple, Tex. 76504

[21] Appl. No.: 740,734

[22] Filed: Nov. 4, 1996

[51] Int. Cl.[6] ..... F02B 71/04

[52] U.S. Cl. ..... 123/46 R

[58] Field of Search ..... 123/46 R, 46 E, 123/46 B

[56] References Cited

U.S. PATENT DOCUMENTS

| | | | |
|---|---|---|---|
| 1,785,643 | 12/1930 | Noack et al. | 123/46 E |
| 2,232,631 | 2/1941 | Renick | 123/46 A |
| 2,406,037 | 8/1946 | Ramsey | 123/46 R |
| 2,815,641 | 12/1957 | Ramsey et al. | 123/46 R |
| 2,980,086 | 4/1961 | Muller | 123/46 A |
| 3,112,060 | 11/1963 | Ollier et al. | 123/46 R |
| 3,214,085 | 10/1965 | Boldt | 123/46 R |
| 3,432,088 | 3/1969 | Steiger | 123/46 B |
| 3,820,337 | 6/1974 | Martin | 123/62 |
| 4,087,205 | 5/1978 | Heintz | 417/324 |
| 4,308,720 | 1/1982 | Brandstadter | 123/46 R |
| 4,459,084 | 7/1984 | Clark | 417/364 |
| 4,803,960 | 2/1989 | Koppen | 123/46 A |
| 4,831,972 | 5/1989 | Barnwell | 123/46 R |
| 4,876,991 | 10/1989 | Galitello, Jr. | 123/46 E |

*Primary Examiner*—David Okonsky

[57] ABSTRACT

A computerized, self-contained, internal supercharged, positive displacement, internal combustion engine that transfers the work being generated in the combustion cylinder directly into useful work in a pump without the disadvantages of crankshafts, camshafts, and powertrain. A piston-rod assembly that has a much smaller frictional surface area replaces the above crankshafts, camshafts, and powertrain. The elimination of the crankshaft, and other associated parts reduces operational, maintenance, and manufacturing cost. Conventional engines that employ a crankshaft as a means of extracting work from the combustion cylinder have reached their innate design limits. This novel device will allow further development of the positive displacement, internal combustion engine; can be employed in certain applications that crankshafted devices cannot; and open new applications. It can be used directly as a pump or in systems requiring a pump. Its application can be stationary, mobile, and transportation vehicles. Employment of this design will aid in reducing emissions that are causing considerable damage to the world's environment and will reduce demands on dwindling petroleum reserves.

3 Claims, 12 Drawing Sheets

COMPUTERIZED INTERNAL SUPERCHARGED ENGINE-PUMP

BACKGROUND OF THE INVENTION

1. Technical Field

This invention relates to a positive displacement, internal combustion engine. More particular, it is a double-acting engine-pump.

2. Background Art

The positive displacement, internal combustion engine has been a major force for almost a hundred years. There has been much research of and modification to production engines, but the innate design has not changed. All production engines utilize a crankshaft and powertrain to convert available work into useful work. The crankshaft and all of the associated parts detract (negative work) from the available work lowering fuel efficiency and power output. This power conversion device creates emissions due to high operating temperature, low stoichiometric ratios, and brief duration of combustion. Measures taken to reduce emissions, reduces the fuel efficiency and power output of the engine. Engines are designed to and must operate on a specific type and grade of fuel.

Four-stroke cycle engines employ a valve train, a fixed device that limits operational parameters. Two-stroke cycle engines are less fuel efficient and have higher emissions than four-stroke. Powertrains are required for transferring the available work generated in the power cylinder via a crankshaft into useful work. Negative work is very high because of the frictional surface of the many parts. Negative work represents lower fuel efficiency and power output. With a period of usage, the many parts will wear out and will have to be replaced. A worn engine will have to have a costly overhaul or be discarded. Failure of the many parts are common. Failure of a single part means downtime.

Lubrication for an engine is petroleum oil, exception being a few synthetics. The function of oil is to reduce coefficient of friction and remove heat from the parts it lubricates. Typically for four-stroke, it is stored in the crankshaft housing (crankcase), and the crankshaft churns it, causing negative work. There is always seepage of gases and unburned fuel from the combustion chamber to the crankcase making it another source of emissions. The oil has to be changed frequently, adding to cost-of-operation. Two-stroke mixes the lubricating oil with the gasoline and is discharged with spent gases.

There have been devices designed to function without crankshafts. Basically, there are two types—free floating piston and piston-rod assembly. Free floating piston devices do not employ a crankshaft or connecting rods. Piston-rod assembly devices do not have a crankshaft, but employ a connecting rod for transferring the available work in the power cylinder into useful work in a pumping device. Prior art of both of these designs have employed some sort of external mechanisms and reservoirs to perform one or more of the four basic functions of recharging with air and fuel, compression stroke, power stroke, and exhaust of spent gases. These external mechanisms and reservoirs are sources of negative work, and restrict or limit performance and applications to one extent or another. None use an internal supercharger. None employ a device (fuel injector-chamber) that affects optimum thermodynamic efficiency and eliminates the creation of emissions. None, because of the above inefficiencies, are in mass production.

The preferred embodiment of said invention does not have a crankshaft or valvetrain. It is the elimination of these parts that reduce the frictional surfaces of the overall design. This reduction of negative work translate into increased fuel efficiency and power output. This invention employs an internal supercharger, part of the piston-rod assembly, to charge the system. Because a crankshaft is not used, large amounts of air-mass (working fluid) can be charged into the power cylinder. The horsepower to displacement and weight ratios will therefore be considerably enhanced. This invention employs a novel fuel injection-chamber, a separate entity, that prevents the formation of nitrogen compounds and allows the use of any suitable fuel. It also allows operation against a head, thereby opening new applications.

SUMMARY

The objective and novelty of the subject power conversion device is to eliminate the parts of inefficiencies used in conventional practices and prior art, and reassemble a device using available and novel technology with parts that will make a fuel efficient, ecological friendly, flexible power conversion device. The result is a Computerized Internal Supercharged Engine-Pump (SCEP), so designated. SCEP is a self-contained, internally supercharged engine-pump that does not rely on crankshafts, valvetrains, or powertrains, or any external mechanisms. It employs a computer and a novel fuel injection-chamber, a separate entity, for timing and controlling the engine's operation. SCEP has features when combined together with a fuel injection-chamber makes it a superior product to conventional practices and prior art.

A single/basic unit of SCEP is comprised of two identical powerheads, and one or more pump unit(s). The two powerheads are diametrically opposed with the pump unit(s) situated in between. There are two different pump units that can be used, a compressor for compressible fluids, and a hydraulic pump for noncompressible fluid. Multiple pump units in any combination can be installed in-line together to form a single engine-pump unit.

The powerhead is comprised of a fuel injector-chamber, intake valve assembly(s), power cylinder, power piston, power rod, supercharger cylinder, supercharger piston, common manifold, and intake manifold. The pump unit, conventional practice, is comprised of cylinder, piston, two drive rods, and a common manifold at each end shared with a supercharger unit. The lone feature of the pump unit that is not conventional is channeled grooves in the cylinder wall of a hydraulic pump. These grooves are necessary to unload the pump for engine operations. When the pistons and the rods are assembled, they become the component, piston-rod assembly.

The piston-rod assembly is the major and only moving component. Its function is to provide for the four basic engine functions (fresh air charge, compression stroke, power stroke, exhaust of spent gas), and transfer pressure created in the power cylinder directly into work in the pump. The mass of the assembly is a design criterion. When the power piston passes its exhaust ports, pressure will be lost. The momentum (mass times velocity) of the assembly must complete opening of exhaust ports and the compression stroke of the opposing power cylinder. The power piston and rod are the conduit for lubrication to the power piston rings, the only part requiring lubrication. The internal supercharger's piston is part of the piston-rod assembly eliminating the necessity of external mechanism to drive it. The supercharger is either a single-acting or double-acting, positive displacement compressor.

The fuel injector-chamber in conjunction with a computer (provided by others) controls operation of SCEP. These two items are separate entities from the engine-pump, but they are very critical to its operation. The fuel injector-chamber is a combination fuel injector(s), primary combustion chamber, and steps-up fuel pressure in the fuel injector-chamber's fuel reservoir. Note: This technology can be retrofitted to production engines.

The engine operation of SCEP is very similar to a two-stroke, uniform flow diesel. Like a diesel, each air charge to the cylinder is the same amount, therefore no throttling; relies on spontaneous combustion for ignition; combustion is an isobaric process. The combustion of a gasoline engine is of short duration and has a high temperature spike. Diesels do not have this temperature spike; therefore, it creates less nitrogen compounds. Studies conducted by Texas A & M revealed that the creation of nitrogen compounds are a function of temperature, and if combustion temperatures are kept below 2,000° C. (2,273° K), nitrogen compounds will not form. A safety pressure switch in the fuel injector-chamber insures that a critical pressure, therefore temperature, is not passed. The combustion temperatures of this invention are kept below 2,000° C. by timed injections of fuel into a primary combustion chamber. The timed injections for a particular power stroke is developed by the computer.

Features encapsulated. SCEP frictional and wear surfaces relative to power output is much less than conventional practices. A textbook study showed that only 30% of fuel was consumed for equal power output. The power cylinder can be charged with large amounts of air. This increases the mean-effective-pressure and enhances the horsepower to displacement and weight ratios. An auxiliary multistage compressor with intercooling driven by exhaust gas can be used to increase these ratios to very high numbers. Therefore, this engine can operate very effective on low combustion temperatures and high stoichiometric ratios, air-mass to total injected fuel mass. Therefore, the spent gasses will not have nitrogen compounds or carbon monoxide if carbon fuels are used. A safety switch in the fuel injector-chamber will prevent the pressure from exceeding a designated point. This feature prevents the temperature from reaching the range of nitrogen compounds formation. Also, it is the reason SCEP can operate against a head. Octane rating is not a consideration; therefore it can operate on any suitable fuel. Simultaneous use of liquid and gas is possible providing each has its own injector. In a system, a single unit operates independent from other units. Lubrication of piston rings can be water. The use of water will add working fluid post compression stroke that will convert more of the heat energy into pressure and reduce the temperature of the system. Water will not leave residues.

Incorporating the above novel art into SCEP will give it superior operational characteristic to conventional practices and prior art. It is fuel efficient, cost effective, and will not create emissions. It can deliver a large amount of power for size and weight. It can operate on all available fuels, including hydrogen. A compressor can be used direct as a compressor or in systems requiring a compressor. A hydraulic pump can be used direct as a hydraulic pump or in systems requiring a hydraulic pump. It can be used wherever a power source is required; stationary, mobile, or transportation vehicles. A powertrain for SCEP is a more efficient hydraulic system. Because of independent operation, the unit arrangement is the prerogative of the designer. A system can be designed with a number of units for maximum output, and then shutdown whatever units are not needed. If a unit malfunctions, it will not affect any of the others. It can benefit existing systems, Example. A pressure pump in a steam generation plant operates from the electricity being generated. From fuel to work in the pump, six conversions are required. SCEP converts the fuel burned in the power cylinder directly into work in the pump. It can operate against a head even though it is a positive displacement hydraulic pump. Its application can be new and flexible. Example. A turbolet's turbine extracts 60% of the work being generated in the combustion chamber; therefore, leaving only 40% of work being generated for thrust. The 40% of available work for thrust is further reduced when the temperature of the combusted gases have to be lower before entering the turbine section leaving a low gas temperature in the nozzle for producing thrust. The turbine-compressor spool can be replaced with a hydraulic engine driven compressor powered by SCEP. The SCEP driven compressor (similar to a ducted propeller) will develop thrust on its own accord. Fuel added to the air stream in like manner of a ramjet will raise temperatures of the air stream. The heated gases will not have to be reduced as they exit the nozzle unimpeded. Since the compressor is developing thrust, and the added heat is augmenting this thrust, it is assumed that 100% of work produced in this system goes for thrust.

DESCRIPTION

DESCRIPTION OF ART

This section describes a single unit as shown in the Figures for examination purposes only. Multiple units in various arrangement and dimension can be designed to suit requirements.

Figure 1:
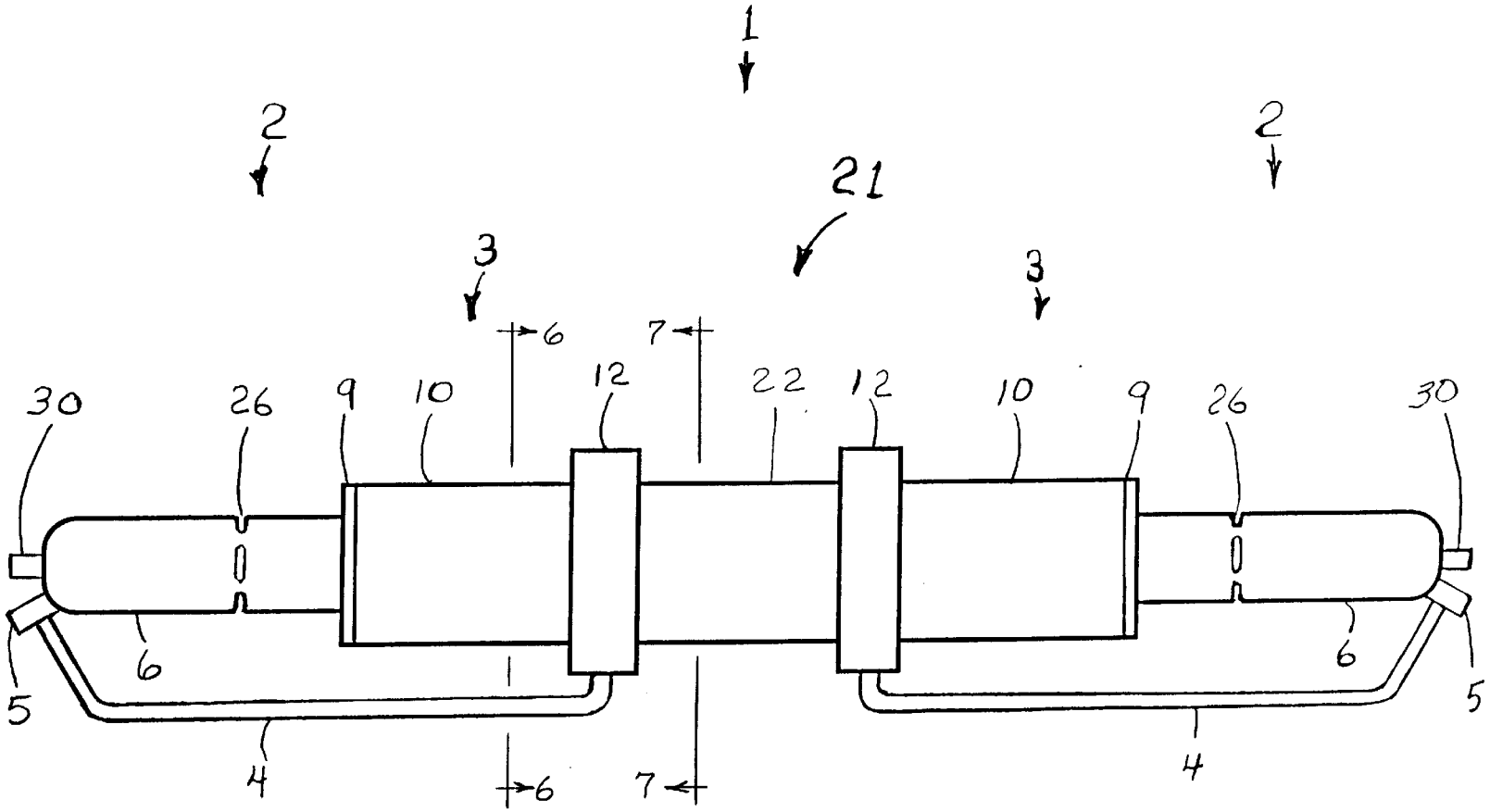
FIG. 1 Depicts layout of a computerized internal supercharged engine-pump 1.

Referring to FIG. 1, an overview of a computerized internal supercharged engine-pump 1 is depicted. The engine section is comprised of two diametrically opposed, positive displacement, internal combustion powerheads 2. A double-acting, positive displacement fluid pump 21 is situated in between. The pump unit as shown is a representative of either a compressor for compressible fluids or a hydraulic pump for noncompressible fluids. Materials and manufacturing are conventional practices, and specific parts can be composite for specific applications.

Figure 2:
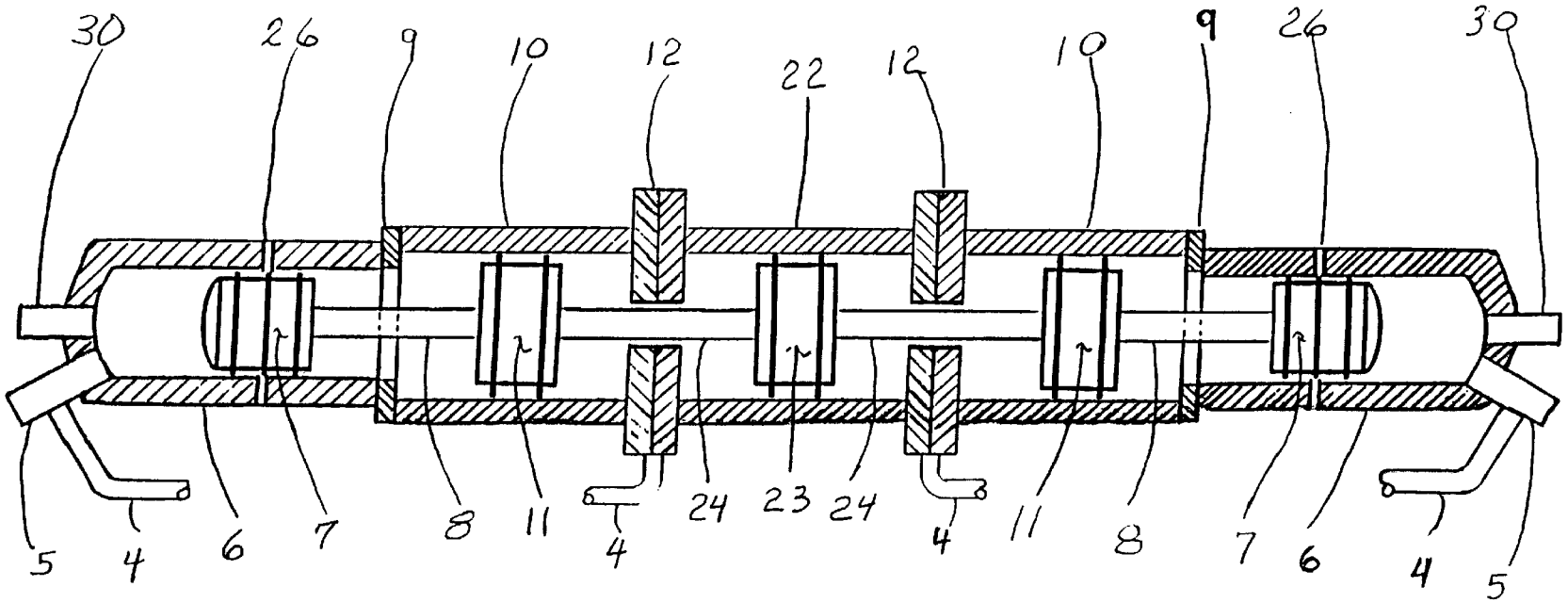
FIG. 2 Depicts cross-sectional view of FIG. 1 with piston-rod assembly 25 at mid stroke.

Referring to FIG. 2, a cross-sectional view of the engine-pump is depicted. Further delineated. The componets that comprise the powerhead are fuel injector-chamber 30 (a separate entity), power cylinder 6, internal supercharger 3 system, and common manifold 12.

The powerhead parts are intake manifold 4, intake valve assembly(s) 5, power cylinder 6, power piston 7, power rod 8, adapter plate 9, internal supercharger cylinder 10, internal supercharger piston 11, and common manifold 12. The common manifolds 12 parts are check flow valves 14, 16, 18, and 20.

The pump 21 as represented here is comprised of the following parts; pump cylinder 22, pump piston 23, and two drive rods 24. There is a common manifold 12 at each end of pump cylinder that is shared with respective supercharger 3.

Figure 3:
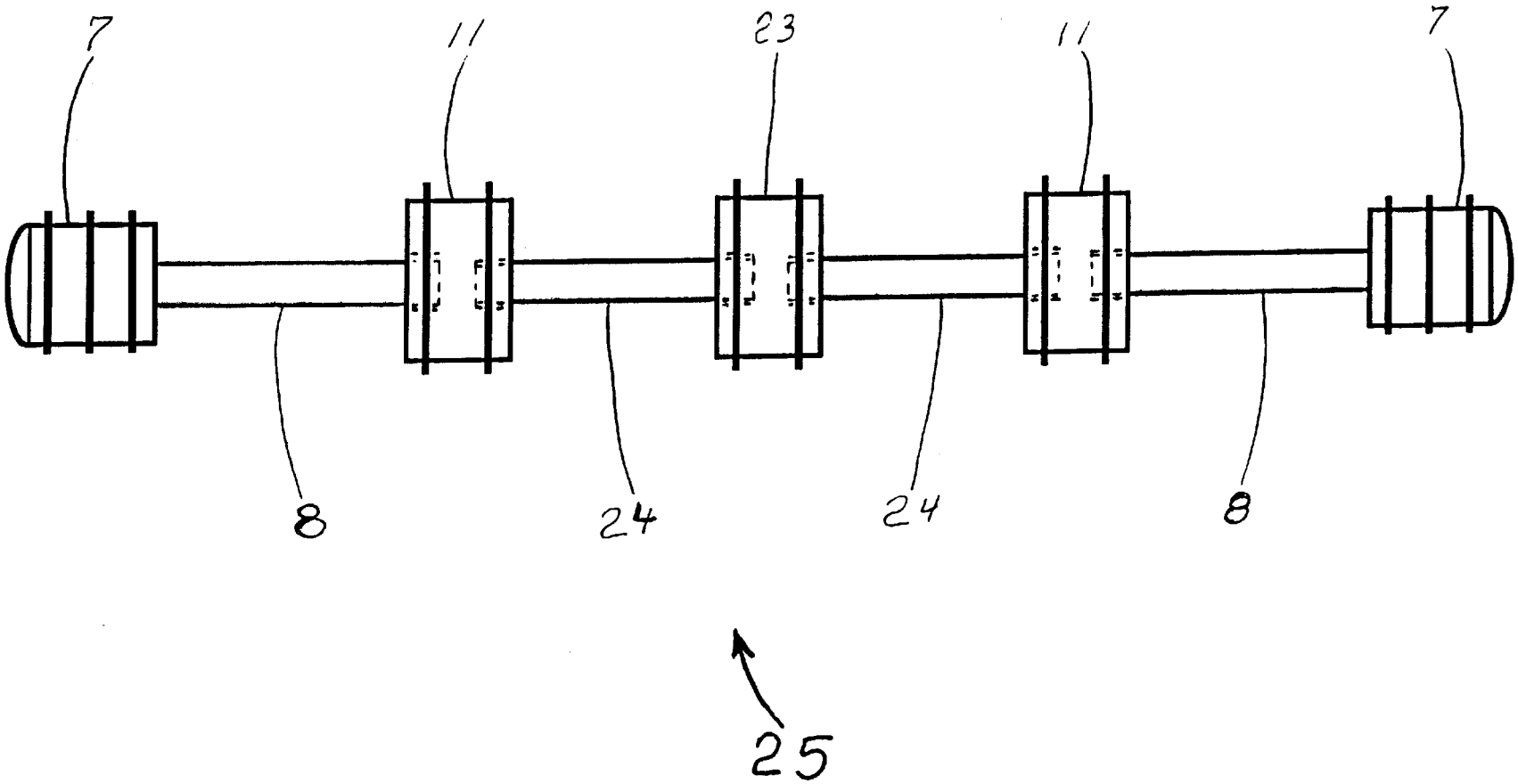
FIG. 3 Depicts piston-rod assembly 25 removed from engine-pump 1.

Referring to FIG. 3, a piston-rod assembly 25 is shown removed from the engine-pump 1. It is a major component. It is the only moving component save for parts of check flow valves. Its motion is reciprocal. It provides for all of the basic functions of the engine-pump 1; fresh air charge, compression stoke, power stoke, and exhaust of spent gasses. Its parts are solid to give mass to the assembly 25 for momentum. The momentum of the assembly 25 is necessary to complete the basic engine functions when force is lost on power piston 7.

The construction of piston-rod assembly 25 begins with the pump piston(s) 23 in the center. There can be one or more pump pistons depending on the number of pump units 21. On each side of the pump piston 23 is a drive rod 24, each connecting pump piston 23 to respective supercharger piston 11, or in the case of multiple pump units 21, to another pump piston 23. On the other side of each supercharger piston 11 is a power rod 8, connecting supercharger piston 11 to respective power piston 7. When operating, the assembly 25 is always in compression; therefore positive attachments are not needed. Holes are bored in pistons face slightly larger than the rod's diameter. These holes serve as receptacles for rods 8 & 24. This will prevent alignment problems and side loads on pistons as the rods 8 & 24 are supported by bearings. In the case where there is a failure, such as an intake valve assembly or fuel injector-chamber 30 blowing out and leaving an open hole in the power cylinder 6 no one part will bear full impact of the assembly's 25 mass. The exception of this method of connection is power piston 7 to power rod 8. Power rod 8 is drilled in center to a prescribed depth to provide a conduit for lubrication. Power piston 7 is composed of sections held together by cap screws. These sections are channeled to provided conduit for lubricant to power piston ring grooves; therefore, the connection has to be water tight.

The parts of the assembly 25 are solid to give mass to system. This mass times velocity at blow-down determines momentum stroke (see below) that is necessary for engine operation. The two primary decelerating forces are the completion of compression stroke in supercharger 3 and opposing power cylinder 6. The pump 21 also contributes significantly to decelerating force. The travel of the assembly 25 is very short; however, both of the above are at their maximum pressure. Because travel is short, friction (drag) is considered to be negligible.

Figure 4:
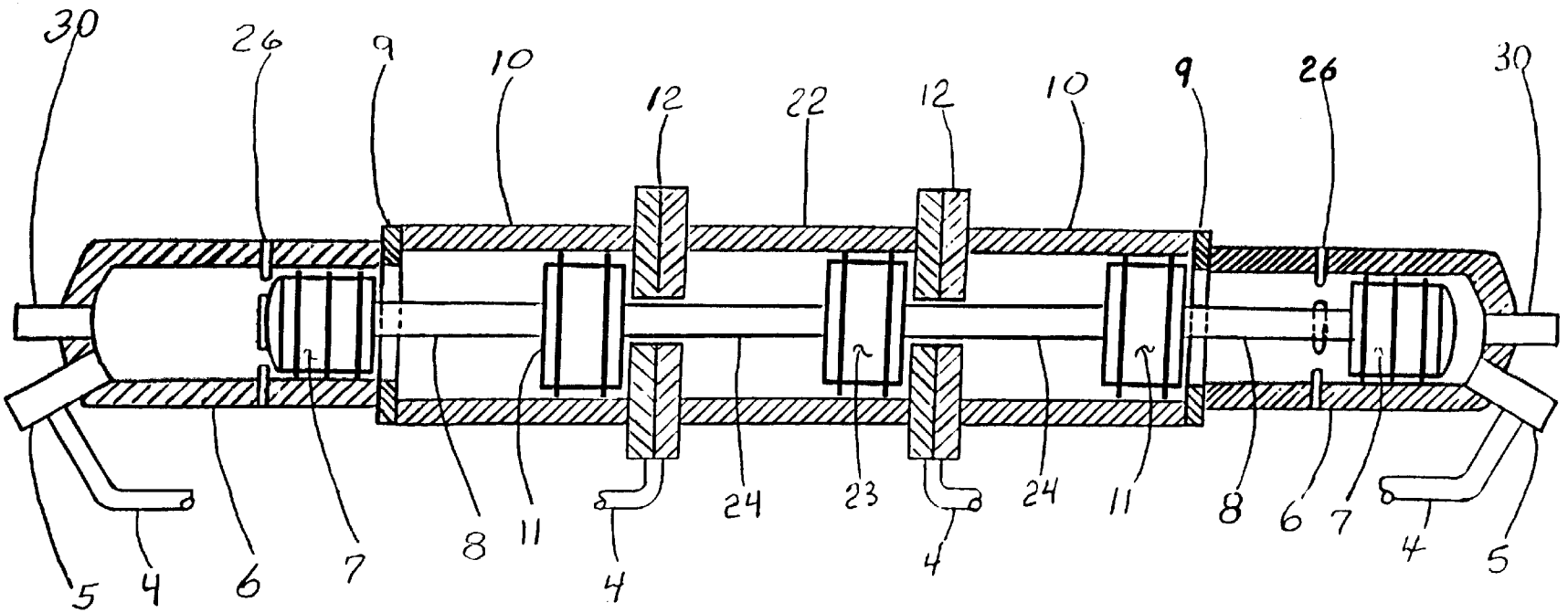
FIG. 4 Depicts cross-sectional view of FIG. 1 with piston-rod assembly 25 at full extension.
Figure 5:
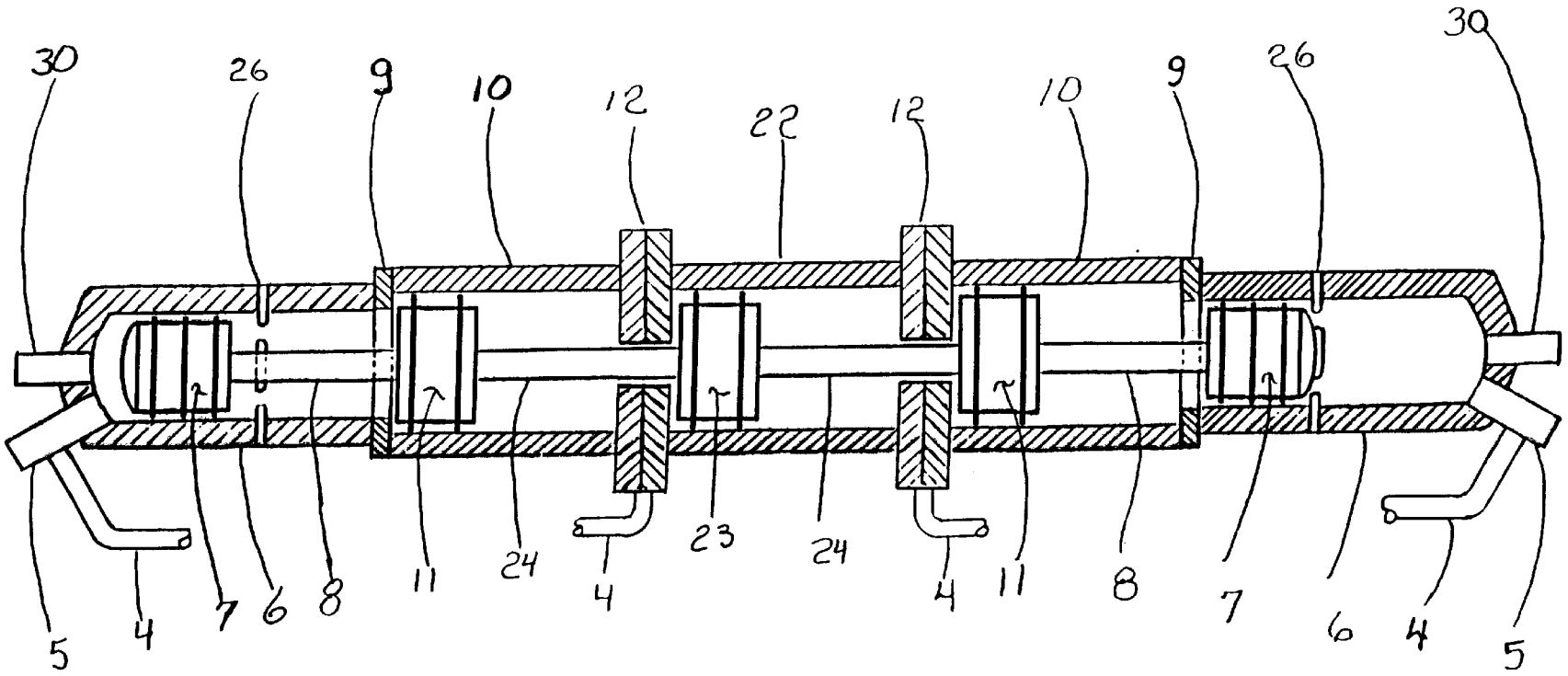
FIG. 5 Depicts cross-sectional view of FIG. 1 with piston-rod assembly 25 at full extension.
Figure 8:
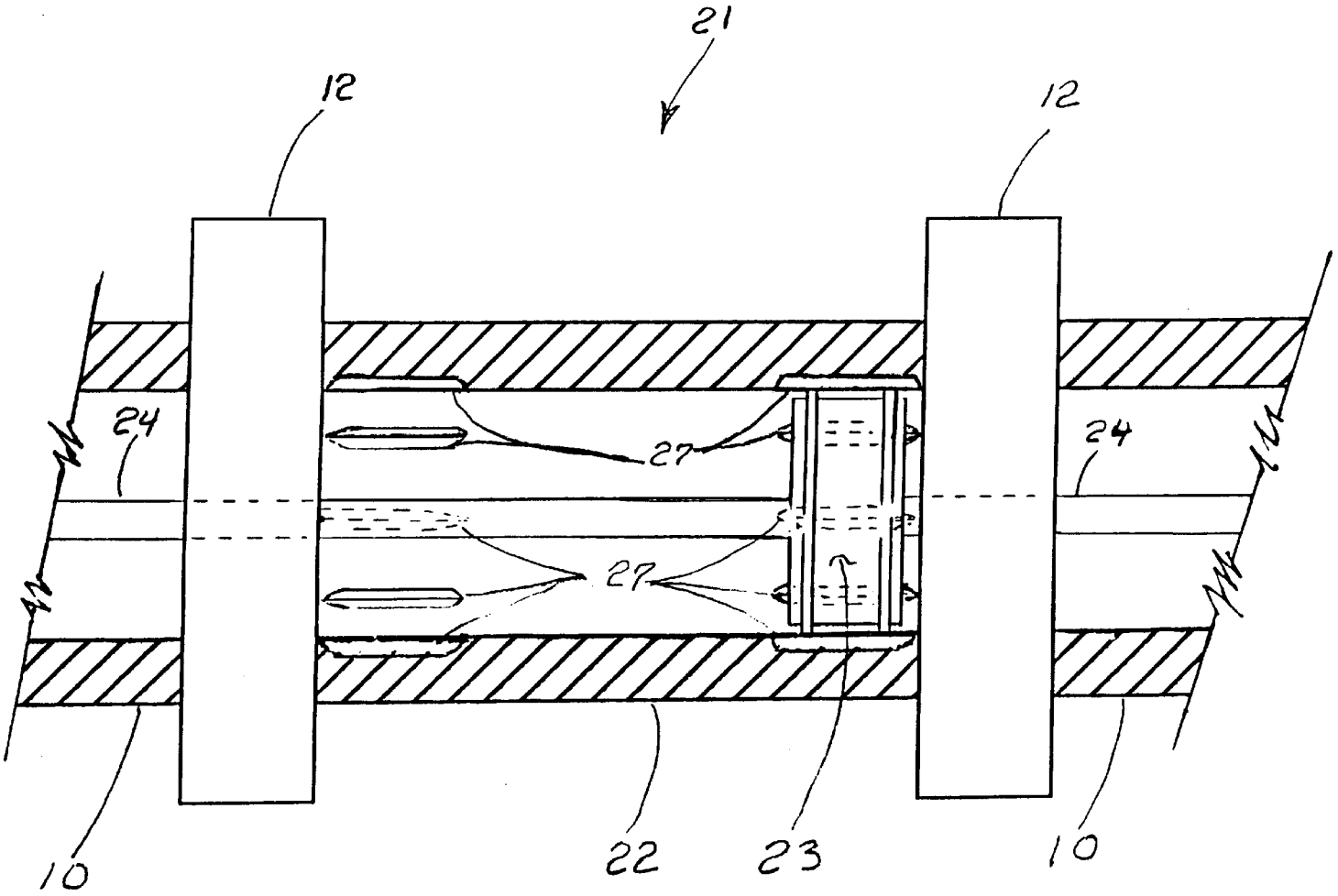
FIG. 8 Depicts view of channeled grooves 27 in hydraulic pump cylinder 22 wall.

Referring to FIG. 5, the assembly's 25 stroke length is from full extension (designed compression ratio), power piston 7 at top of power cylinder 6 (equivalent to top dead center), to full extension (see FIG. 4) in opposing power cylinder 6 with power piston 7 at bottom of power cylinder 6 (equivalent to bottom dead center). Power stroke is from full extension to when exhaust ports 26 are uncovered and blow-down occurs. Momentum stroke is travel distance from blow-down until the assembly 25 comes to rest with power piston 7 at bottom, and in opposing power cylinder 6, the opposing power piston 7 is at full extension Therefore, full stroke length is equal to power stroke plus momentum stroke. A noncompressible fluid pump 21 needs to be unloaded before blow-down for assembly 25 to be at proper velocity for momentum stroke Engineered grooves 27 are channeled into pump cylinder's 21 wall for this purpose. These grooves 27 are located at each end of the cylinder (see FIG. 8). When the piston rings pass these grooves 27, trapped fluid between pump piston 23 and deadhead 28 (common manifold 12) will flow around piston 23 thereby unloading back force on assembly 25. The pump 21 will also be unloaded when the assembly 25 begins to initially accelerate. Therefore, effective work for a hydraulic pump's power stroke is from load point to unload point.

The full stroke length is designed into the system and for normal operations, it will be the same travel. Like the operation of a conventional diesel, each air-mass charge will be the same, therefore no throttling. The formula for dimensioning a supercharger 3 is bore of supercharger cylinder 10 minus cross-sectional area of drive rod 24 times full stroke length. Stroke length is fixed for a design; therefore for a designed air-mass, the bore will have to be calculated. It is necessary to used a standard atmosphere, density, for calculation. The formula is: designed air-mass in power cylinder 6 at closing of exhaust ports 26 plus mixing boundary layer (air-mass discharge with spent gases) divided by volumetric efficiency.

Figure 6:
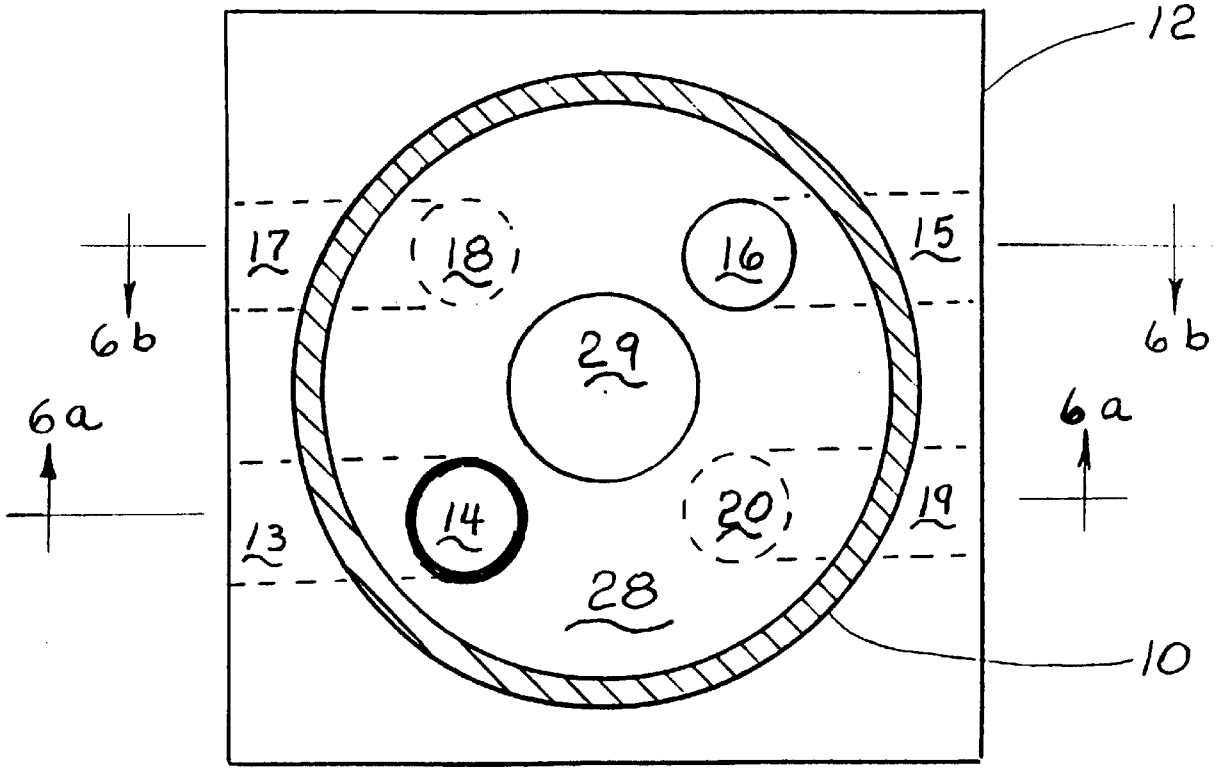
FIG. 6 Depicts plan view of common manifold 12 on line 6—6.
Figure 6A:
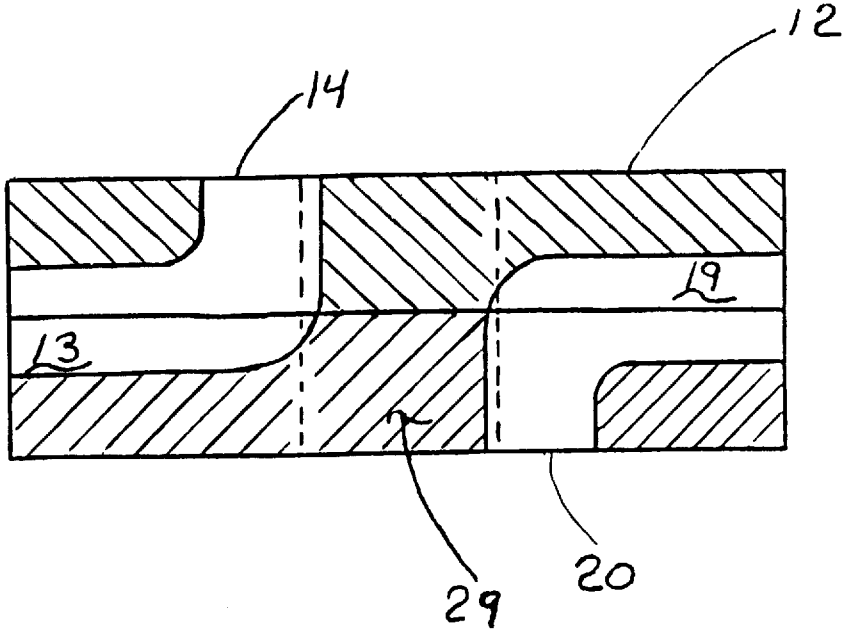
FIG. 6*a* Depicts cross-sectional view of common manifold 12 on line 6*a*—6*a*.
Figure 6B:
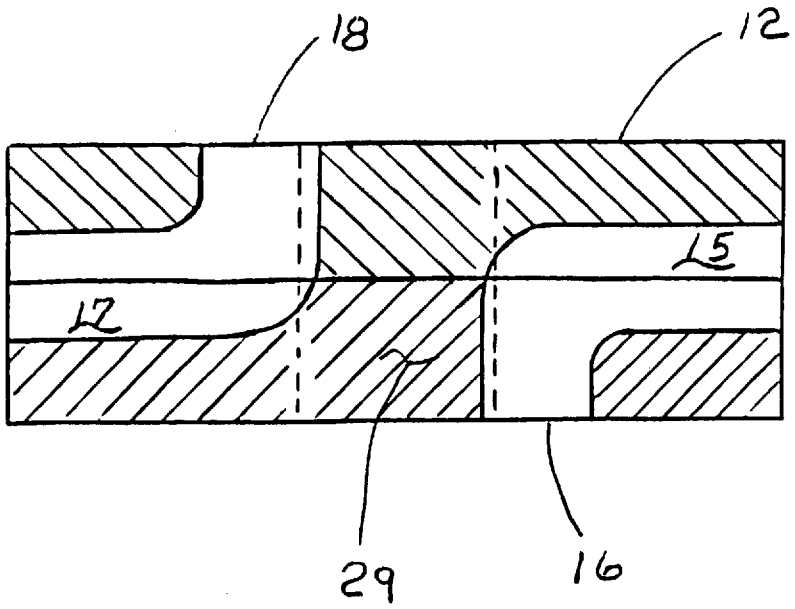
FIG. 6*b* Depicts cross-sectional view of common manifold 12 on line 6*b*—6*b*.
Figure 7:
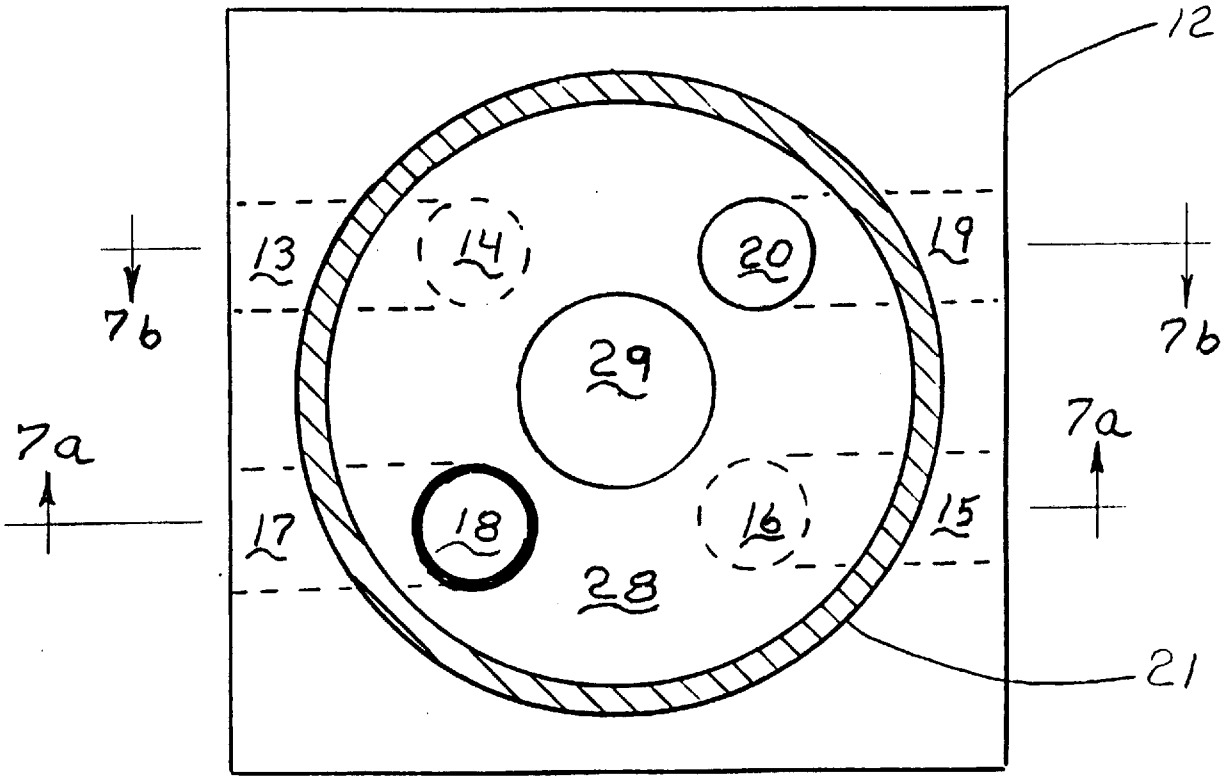
FIG. 7 Depicts plan view of common manifold 12 on line 7—7.
Figure 7A:
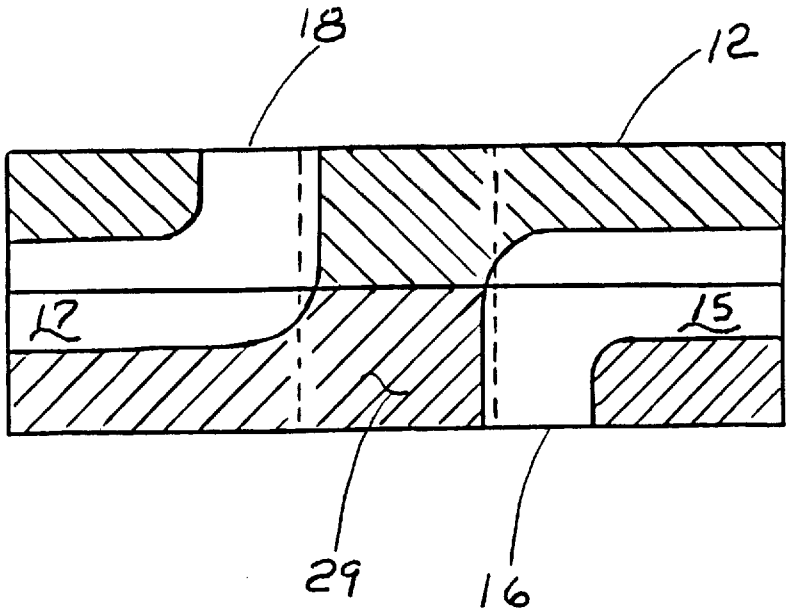
FIG. 7*a* Depicts cross-sectional view of common manifold 12 on line 7*a*—7*a*.
Figure 7B:
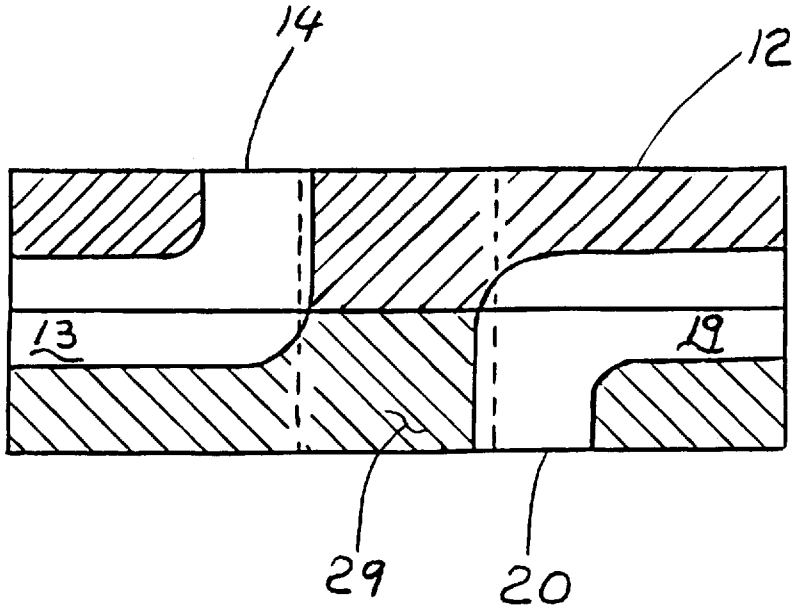
FIG. 7*b* Depicts cross-sectional view of common manifold 12 on line 7*b*—7*b*.

Referring to FIGS. 6 & 7. FIG. 6 gives a plan view of common manifold 12 on line 6—6, supercharger 3. The plan view shows inlet check flow valve 14, discharge check flow valve 16, deadhead 28, and rod seal and bearing housing 29. FIG. 6*a* is a cross-sectional view 6*a* on line 6*a*—6*a* showing supercharger inlet duct 13 and pump discharge duct 19. FIG. 6*b* is a cross-sectional view 6*b* on line 6*b*—6*b* showing supercharger discharge duct 15 and pump inlet duct 17. FIG. 7 gives a plan view of common manifold 12 on line 7—7, pump 21. The plan view shows inlet check flow valve 18, discharge check flow valve 20, deadhead 28, and rod seal and bearing housing 29. FIG. 7*a* is a cross-sectional view 7*a* on line 7*a*—7*a* showing pump inlet duct 17 and supercharger discharge duct 15. FIG. 7*b* is a cross-sectional view 7*b* on line 7*b*—7*b* showing discharge pump duct 19 and supercharger inlet duct 13.

There are four basic functions an internal combustion engine has to perform for it to operate; charged with fresh air, compression stroke, power stroke, and exhaust of spent gasses. Following is a designate air-mass charge (working fluid) as it flows into and out of the engine-pump 1.

Referring to FIGS. 4, 6, 6*a*, & 6*b* the exhaust ports 26 are uncovered, and the piston-rod assembly 25 is at full extension in the opposing power cylinder 6. The power stroke in the opposing power cylinder 6 will accelerate the assembly 25 drawing in the designated charge from ambient through common manifold 12 inlet conduit 13 and check flow valve 14 (see FIG. 6 & 6*a*) into supercharger cylinder 10. The discharge check flow valve 16 will be closed. Power stroke in power cylinder 6 (see FIG. 5) will reverse the direction of assembly 25, and supercharger piston 11 will compress the designated charge through discharge check flow valve 16 and duct 15 into intake manifold 4, inlet check flow valve 14 is closed. When exhaust ports 26 are opened, the previous charge now pressurized spent gases will discharge through exhaust ports 26. The drop in pressure in the power cylinder 6 will cause pressurized designated charge in intake manifold 4 to force open intake check flow valve 5, and the designated charge will scavenge residual gases from power cylinder 6, 'uniform flow'. The mixing boundary layer of fresh air and spent gases will be discharged also. The power stroke in the opposing power cylinder 6 will accelerate the assembly 25 and close the exhaust ports 26, beginning the compression stroke of designated charge. The fuel injector-chamber 30 at timed point will begin injecting fuel into chamber 30, containing partial designated charge, for ignition. When the assembly 25 reaches full extension and reverses direction, ignited fuel and thoroughly vaporized, hot, unburned fuel will be discharged from the chamber 30 into the power cylinder 6. Fuel will be injected at timed points until combustion is completed. When the exhaust ports 26 are opened, the spent designated charge will discharge from power cylinder 6 through exhaust ports 26, beginning a new cycle.

Reference FIG. 7, 7*a*, and 7*b*, the fluid flow through pump 21 is conventional practices. On the side of power stroke, working fluid will be drawn in through common manifold 12 inlet conduit 17 and check flow valve 18, open position, into pump cylinder 22. The discharge check flow valve 20 of conduit 19 will be closed. On opposing side of power stroke, compression stroke, worked fluid will be discharging through opposing common manifold 12 check flow valve 19, open position, and conduit 20. The opposing common manifold's 12 inlet check flow valve 18 of conduit 17 will be closed.

Power stroke is performed and control by two components that are not a part of this application—the computer 31 (to be provided by others) and fuel injector-chamber 30 (a separate entity, patent application at a later date). The computer 31 is a control box 31 that controls timing by timed injections of fuel. A solenoid operates the injector metering needle. The control box's 31 function is to develop a p/v curve from operators demand for power. This curve is converted into time increments, a linear curve. The control box 31 counts these increments and sends an electric signal to the injector solenoid when a precise amount of fuel is to be injected to maintain the p/v curve. The fuel injector-chamber 30 is a combination fuel pressure step-up device, fuel injector, and primary combustion chamber device. A typical power stroke would be: The compression stroke will step the pressure up mechanically in injector's fuel reservoir. As the assembly 25 approaches full extension, the control box 31 will signal solenoid to lift injector metering needle off of seat, and a precise amount of fuel will flow into chamber 30 for ignition. The fuel flow will continue until designated temperature is reached (not to exceed 2,000° C., 2,273° K). This temperature will be maintained through out combustion (isothermal, therefore isobaric) by timed injections of fuel. After combustion is completed, the expansion will be in normal fashion.

Startup for the engine-pump 1 is accomplished by control box 31 being in a startup mode and injecting fuel into chamber 30. Three strokes are required before normal operation can be achieved. On shutdown, there will be a fresh air charge in both power cylinders 6, and the assembly 25 will be approximately mid stroke. The pressure in the power cylinders 6 will leak down close to ambient if idle for a period of time. A hydraulic pump 3 must be unloaded. This is accomplished by opening bypass valves (not part of engine-pump) on discharge lines. The first stroke, partial, will start when fuel supplied to fuel reservoir 30 by an external fuel pump (not part of engine-pump), begins to dribble fuel into chamber 30. Ignition will be by a heat element (glow plug). Its supercharger 3 and the opposing power cylinder 6 will not be fully charged; therefore, the velocity of assembly 25 at blow-down will have to be adjusted accordingly. When assembly 25 reaches full extension in opposing power cylinder 6, its supercharger 3 will have drawn in a full air-mass charge. However, its power stroke, second stroke, will also have to be modified, because the power cylinder 6 of initial stroke will not have a full charge of air-mass. The charge in its intake manifold 4 is partial, and because of this, the check flow valve in intake assembly 5 may have to be opened mechanically. Stroke two, the opposing supercharger 3 is compressing a full air-mass charge and initial supercharger 3 is drawing in a full air-mass charge. Stroke three, will not be a work stroke, but at its completion the engine is ready for normal operation with the control box 31 automatically switching from startup mode into normal operation.

What is claimed:

1. An internal combustion engine comprising a pair of aligned engine powerheads and having a common double acting pump therebetween; each said engine powerhead including a power cylinder and a supercharger cylinder; each of said power cylinders, said supercharger cylinders and said double acting pump having a respective piston; all of said pistons reciprocating along a common longitudinal axis of said aligned engine powerheads and each fixed to a power rod assembly for simultaneous actuation; a respective common manifold assembly being juxtaposed between each of said engine powerheads and said common double acting pump; each said common manifold having a valve assembly providing isolated flow into and out of a respective side of the double acting pump and isolated flow into and out of the associated supercharger cylinder; the isolated flow displaced by each associated supercharger is lead to a respective power cylinder and the isolated flow displaced by the double acting pump is used to perform work.

2. The engine of claim 1 wherein the power rod forms a lubricant channel to each respective power piston.

3. The engine of claim 1 wherein the double acting pump includes engineered grooves in the cylinder wall to unload the pump.

* * * * *